US006280287B1

(12) United States Patent
Keith et al.

(10) Patent No.: US 6,280,287 B1
(45) Date of Patent: Aug. 28, 2001

(54) BREAST SUPPORT GARMENT

(76) Inventors: Phyllis Keith, 506 W. Ridgeline Dr., Boise, ID (US) 83702; Sarah Lorenz, N. 4020 Nettleton, Spokane, WA (US) 99205

( * ) Notice: Subject to any disclaimer, the term of this patent is extended or adjusted under 35 U.S.C. 154(b) by 0 days.

(21) Appl. No.: 09/595,200

(22) Filed: Jun. 16, 2000

(51) Int. Cl.[7] ..... A41C 3/00
(52) U.S. Cl. ..... 450/1; 450/41
(58) Field of Search ..... 450/1, 2, 7, 8, 450/12, 16, 23, 78

(56) References Cited

U.S. PATENT DOCUMENTS

| | | | | |
|---|---|---|---|---|
| 3,306,299 | * | 2/1967 | Paramore | 450/86 |
| 3,465,754 | * | 9/1969 | Lockwood et al. | 450/86 |
| 5,149,293 | * | 9/1992 | Gable | 450/86 |
| 6,110,007 | * | 8/2000 | Rittmann | 450/86 |

* cited by examiner

*Primary Examiner*—Gloria M. Hale
(74) *Attorney, Agent, or Firm*—Ormiston & McKinney, PLLC

(57) ABSTRACT

A support garment for a disabled woman. The garment includes a main body formed by shoulder supports, a torso encircling band, and a pair of breast cups interspaced between and connecting the shoulder supports and the torso encircling band. A pair of arced casings affixed to the body each pass from one shoulder support over one breast cup, between both breast cups, and then terminating with an exit under the other breast cup. A pair of transfer casings are affixed to the torso encircling band each located under one breast cup and below the arced casings. Buckles are affixed to the torso encircling band between the transfer casings. The torso encircling band includes two stays each generally located between a transfer casing and the exit of an arced casing. Attached to each stay is a guide. A draw strap is loosely contained within each arced casing with one end affixed to a shoulder support and the second end exiting the arced casing, passing through one guide, then through one transfer casing, and ultimately secured by a buckle.

20 Claims, 5 Drawing Sheets

BREAST SUPPORT GARMENT

FIELD OF THE INVENTION

The present invention relates generally to breast support garments and, more particularly, to a breast support garment that is more easy for disabled women to use than conventional brassieres.

BACKGROUND

Disabled individuals, particularly those with arthritis, often encounter difficulty when donning and removing clothing. These difficulties are in large part due to the strength, range of motion, and dexterity required to attach and detach hooks and eyes and to manipulate zippers, buttons and the like. For most people, dressing and undressing is an everyday occurrence that requires little time and thought. However, many disabled persons find the task of dressing and undressing both time consuming and difficult. Brassieres, in particular, present problems for disabled women. In general, a conventional brassiere may be characterized as having three main components. The first component is a pair of cloth cups designed to encircle or partially encircle a woman's breasts. The second component relates to some form of a support system to hold and lift the breasts by providing requisite force on the cloth cups via shoulder straps or otherwise. The third component, a torso encircling band, is added to prevent the cups from sliding or "creeping" up over the breasts as a result of this upward force. This band, generally elastic, is secured to the bottom of each cup and serves to anchor the brassiere to the wearer's midriff region, holding the breast cups in place. The torso encircling band of conventional brassieres wraps around a person's chest connecting in the front or the back with a series of small hooks and eyes. Those who lack coordination or cannot grip a strap using both arms have extreme difficulty securing the brassiere in place.

Over the past century, countless innovations in brassiere design have been both patented and commercialized, many having in common the sometimes mutually exclusive objectives of providing improved breast support, appearance and comfort. Some are adapted for the needs of women who engage in athletics or who require a bra suitable for wear with strapless, low back or backless apparel. Some are designed for the full figured woman or for less endowed women desiring to enhance their natural appearance. Still others are designed to reshape the breast in a manner believed to be fashionable for a respective time period. Despite the large number of brasserie designs available on the market and disclosed in the prior art there is a remarkable absence of support garments designed to meet the special needs of the disabled.

Conventional brassieres for the most part are ill-suited for the arthritic and the otherwise disabled. Some efforts have been made to design brassieres to meet the special needs of the disabled. For example, U.S. Pat. No. 3,827,441 issued to Lois Rudolph in 1972 discloses a brassiere with an adjustable elastic shoulder support system fitting around the back of the wearer's neck like a halter top. Rudolph's brassiere also includes a torso encircling band formed by two solid, but flexible, curved stays each attached to one breast cup and extending around one side of the wearer's torso securing the brassiere in place. In 1979 U.S. Pat. No. 4,300,568 issued to Charles Blankmeister for an improved torso encircling band. The design includes a long draw strap for cinching the band around the wearer's torso. The draw strap passes through two rings. The rings are attached to the opposing sides of the brassiere that pass around to the wearer's back. When the brassiere is in place, the user, with either hand can pull the draw strap, cinching the two sides together in the back.

In 1989 U.S. Pat. No. 4,879,866 issued to Harold Hull for a brassiere design incorporating loops below the breast cups on the front of the garment and a draw strap attached to the torso encircling band in the the back. The wearer, slipping the garment over her head, inserts her thumbs into the loops to pull down from the front and then reaches behind grasping the draw strap to slide the garment into place. Francine Rainville received two patents for a front opening brassiere designed for a handicapped person, specifically, U.S. Pat. No. 4,917,651 issued in 1988 and U.S. Pat. No. 5,032,104 issued in 1990. Rainville's design provides a series of loops allowing a wearer who cannot grip to pull on the loops drawing the front of the brassiere together.

U.S. Pat. No. 5,951,634 issued to Rosie and Tonya Brown in 1998 for a brassiere designed for an arthritic woman. Their design includes detachable shoulder support straps and a torso encircling band formed by two body straps that cross over each other and pass around the wearer's body below her breasts to attach either in the front or in the back. The shoulder and body straps use Velcro to allow the wearer to more easily remove the garment.

Unfortunately, many disabled women have no, or extremely limited, mobility in one or both arms. While the designs described above provide some limited benefits for many disabled women, none allow a woman to easily slip on, adjust, and later remove a brassiere using only one arm.

SUMMARY

The present invention is directed to a breast support garment that is easier for disabled women to use than conventional brassieres. The garment includes a main body formed by shoulder supports, a torso encircling band, and at least one breast cup interspaced between and connecting the shoulder supports and the torso encircling band. An arced casing affixed to the body passes around at least a portion of the breast cup. A draw strap is loosely contained within the arced casing with one end affixed to a shoulder support and the free end exiting the arced casing The torso encircling band may also include a stay generally located near the exit of the arced casing and a buckle. Attached to the stay is a guide. The free end of the draw strap, exiting the arced casing, passes through the guide and is received by the buckle securing the draw strap.

Not unlike a conventional tank top, a disabled person can slip the garment over her head using one arm. Once in place, each draw strap is gently extended away from the body securing the garment against the body and around the breasts. Passing through the guides, the draw straps also constrict the torso encircling band providing lateral breast support. The extended draw straps is are then secured by the buckles. To remove, the garment, the draw straps are released from the buckles allowing the garment to loosen. The garment can then be pulled off over the head using one arm.

The invention, as summarized above and defined in the claims at the end of this Specification, may be better understood with reference to the drawings and the following detailed description.

DESCRIPTION

Figure 1:
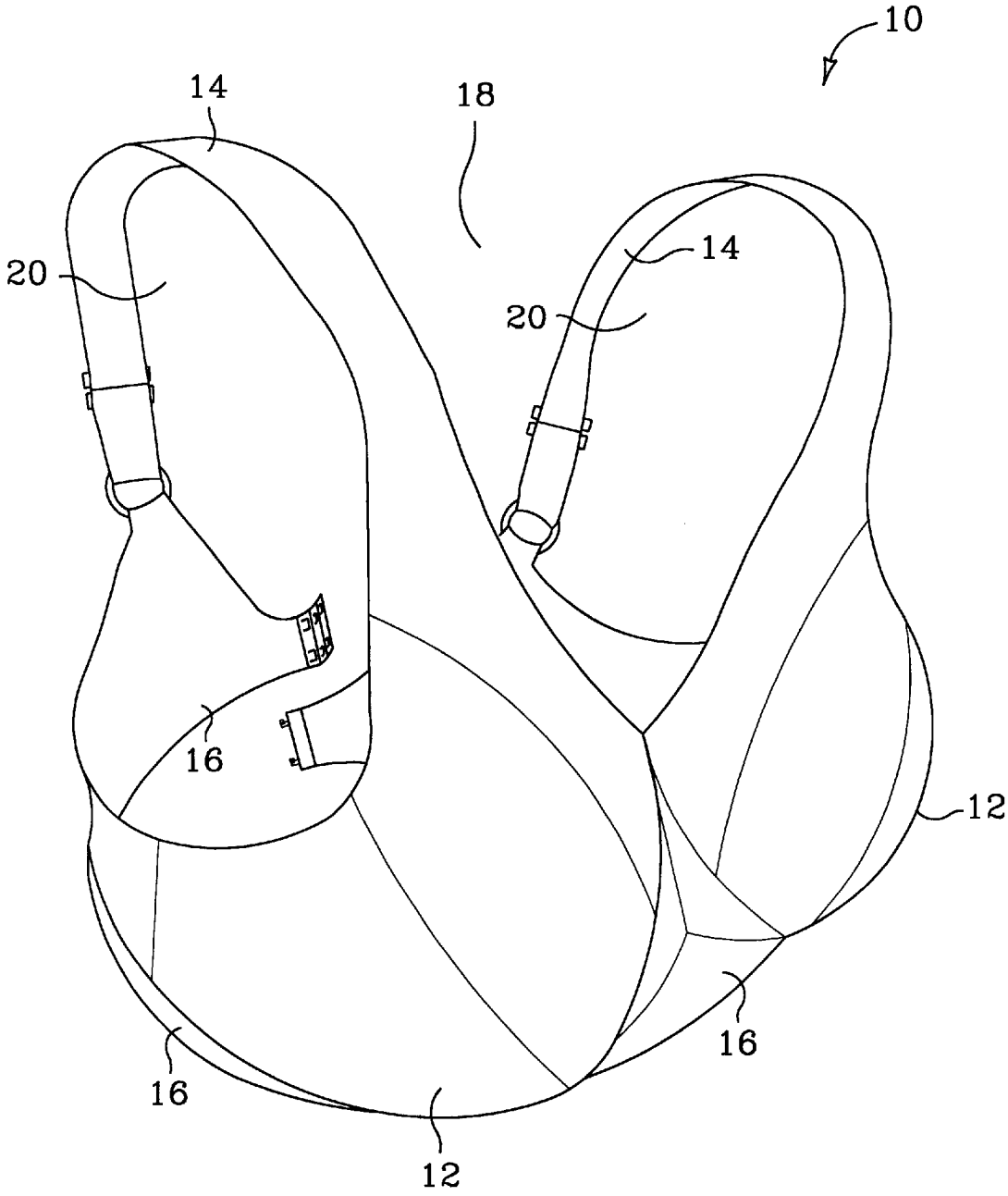
FIG. 1 Prior Art
FIG. 1 is an illustration of a conventional brassiere.

While it is envisioned that the present invention will be embodied in a brassiere, it may also be incorporated into any garment—such as a swim suit for instance—that provides breast support. To better understand the advantages of the subject invention, the construction of a conventional brassiere 10 is illustrated in FIG. 1. Conventional brassiere 10 may be characterized as having three main components. The first component is a pair of cloth cups 12 designed to encircle or partially encircle a woman's breasts. The second component relates to a shoulder support system to hold and lift the breasts by providing requisite upward force on cloth cups 12 via shoulder supports 14 or otherwise. The third component, torso encircling band 16, provides lateral breast support while preventing cups 12 from sliding or "creeping" up over the breasts. This band 16 is secured to the bottom of each cup 12 in the front and, in many cases, to the shoulder supports 14 in the rear. Encircling band 16 anchors the brassiere to the wearer's midriff region, holding the bottom of cups 12 in place. The design provides a neck opening 18 and two arm openings 20.

Construction

Figure 2:
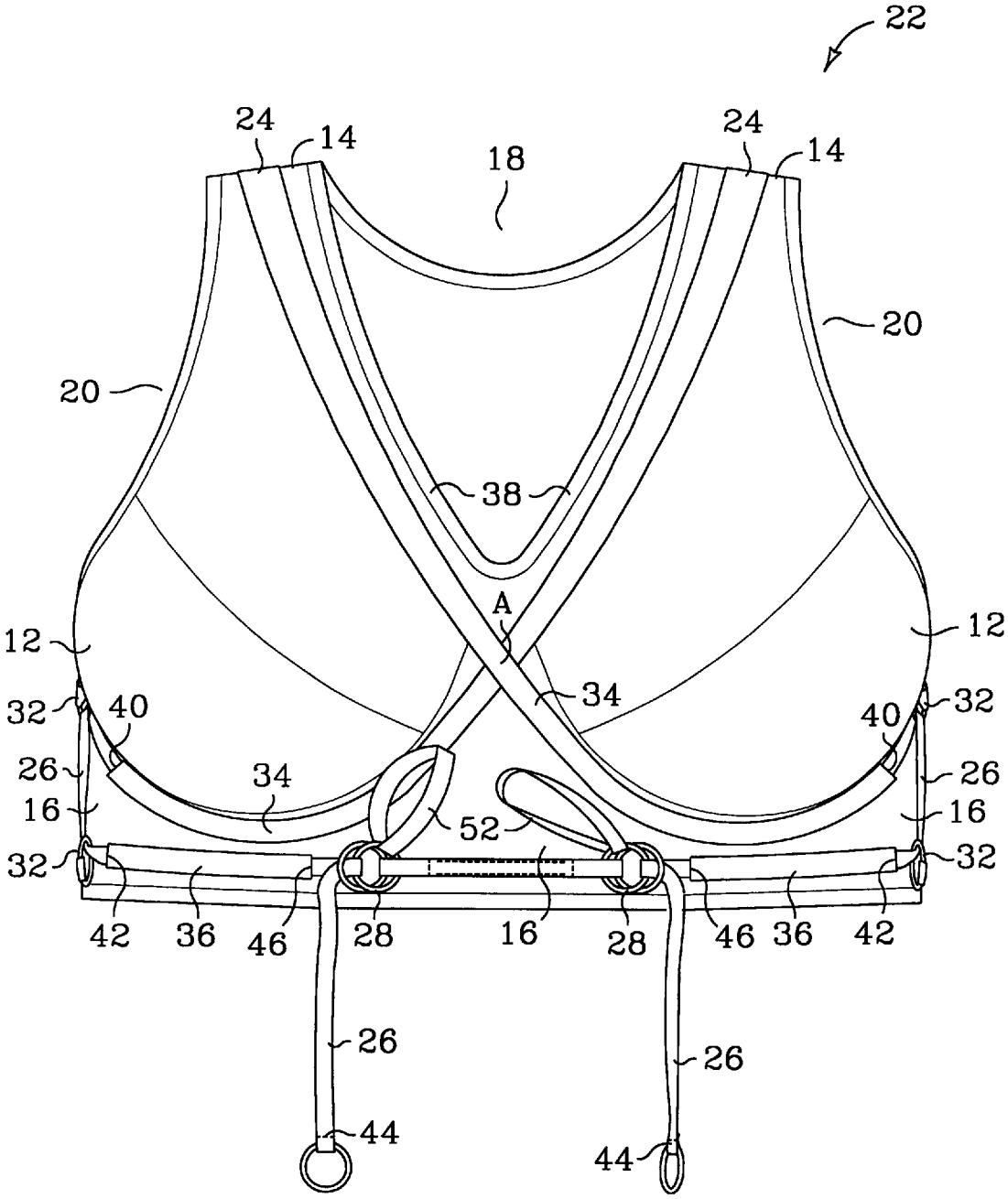
FIG. 2 is a front view of one embodiment of the invented brassiere illustrating the casings, the draw straps, and buckles.
Figure 3:
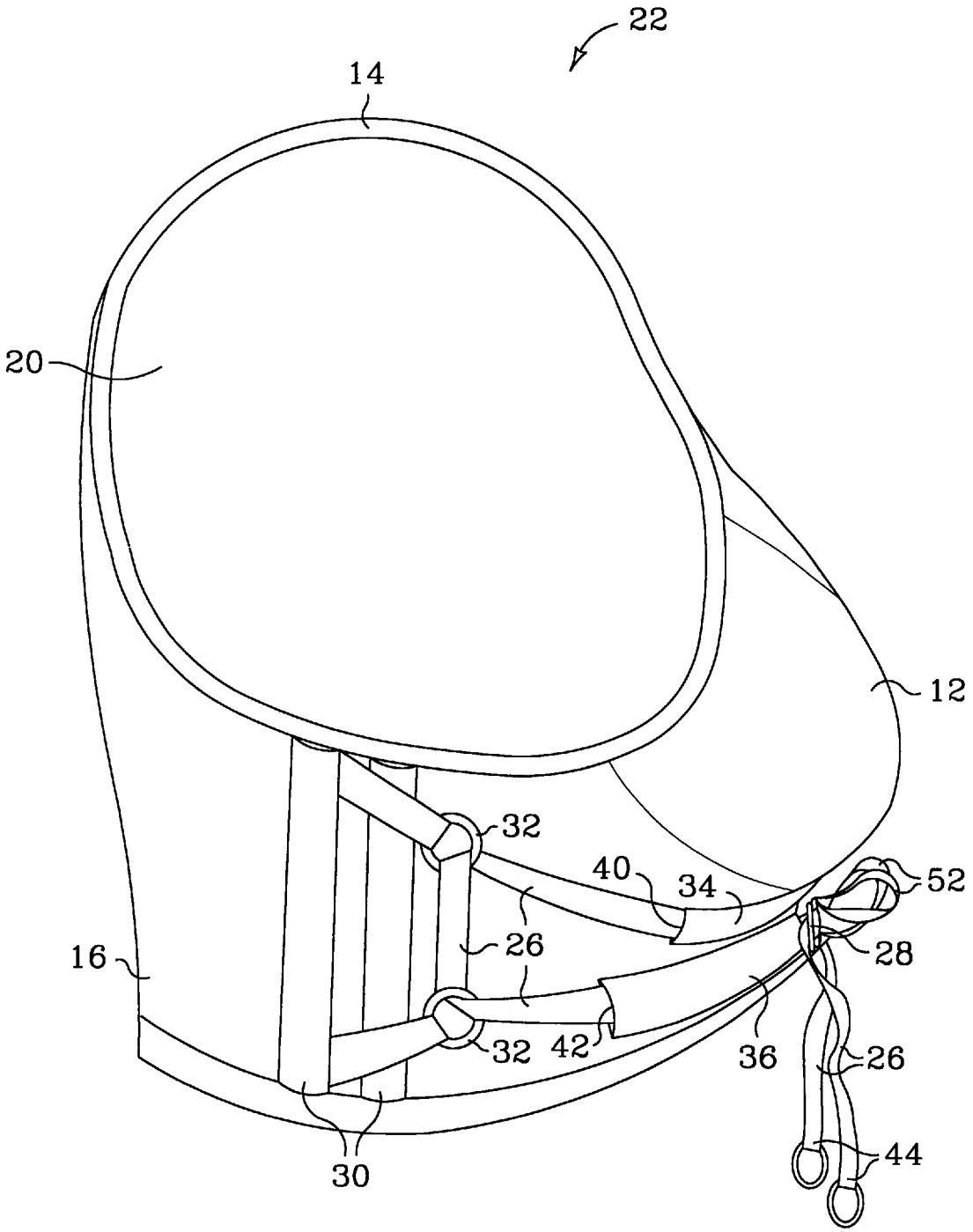
FIG. 3 is a side view of the brassiere of FIG. 2.

Referring now to FIGS. 2 and 3, one embodiment of the present invention incorporates the three main components from FIG. 1 into a brassiere, generally referenced as 22. Brassiere 22 may be put on, adjusted, and later removed using only arm. In addition to breast cups 12, shoulder supports 14 and torso encircling band 16—which form the main body of brassiere 22—brassiere 22 includes casings 24, draw straps 26, buckles 28, and, referring to FIG. 3, stays 30 and guides 32. Casings 24, affixed to the body of brassiere 22, form hollow passages and may be constructed from any suitable fabric preferably with a slick texture such as satin. Each casing 24 is made up of an arced portion 34 and may include a transfer portion 36. Each arced portion 34 begins on one shoulder support 14 and traverses along neckline 38 passing over the breast cup nearest the given shoulder support, between both breast cups, and finally under the other breast cup. Each casing 24 may, but need not, include transfer portion 36 affixed to torso encircling band 16, passing laterally under one breast cup 12 and below the corresponding arced portion 34. The arced and transfer portions 34, 36 of each casing 24 may form one continuous path, or as shown in FIG. 2, each arced portion 34 may terminate with an exit 40 above an entrance 42 for the corresponding transfer portion 36.

To create their hollow shape, each casing 24 may be formed by stitching each side of a flat fabric strip to the body of brassiere 22 such that the inside walls of the casing 24 are formed by the fabric strip and the body of brassiere 22. Alternatively, the hollow shape may be achieved by shaping a flat fabric strip into a tube and stitching tube's sides to the body of brassiere 22. In the second case, the inside walls of casings 24 are formed by the fabric strip. In both cases, casings 24 cross one another at a point A between breast cups 12. Consequently, at point A one casing 24 is not attached to the body of brassiere 22 but may be attached to the outer surface of the other casing 24.

Still referring to FIG. 2, loosely contained within each casing are draw straps 26 used to firmly secure brassiere 22. One end of each draw strap 26 is affixed to the shoulder support 14 near the beginning of the casing's arced portion 34. Except for its attached end, each draw strap 36 freely passes through the arced portion 34 extending through exit 40 and, if present, continuing through and exiting the casing's transfer portion 36. Free end 44 of each draw strap 36 remains freely accessible near the center of torso encircling band 16. To provide easy access, buckles 28 are affixed to torso encircling band 16 below point A near the center of the wearers chest. However, buckles 28 may also be located according to the unique needs of each person. Free end 44 of each draw strap 26 is secured by the nearest buckle 28.

Figure 4:
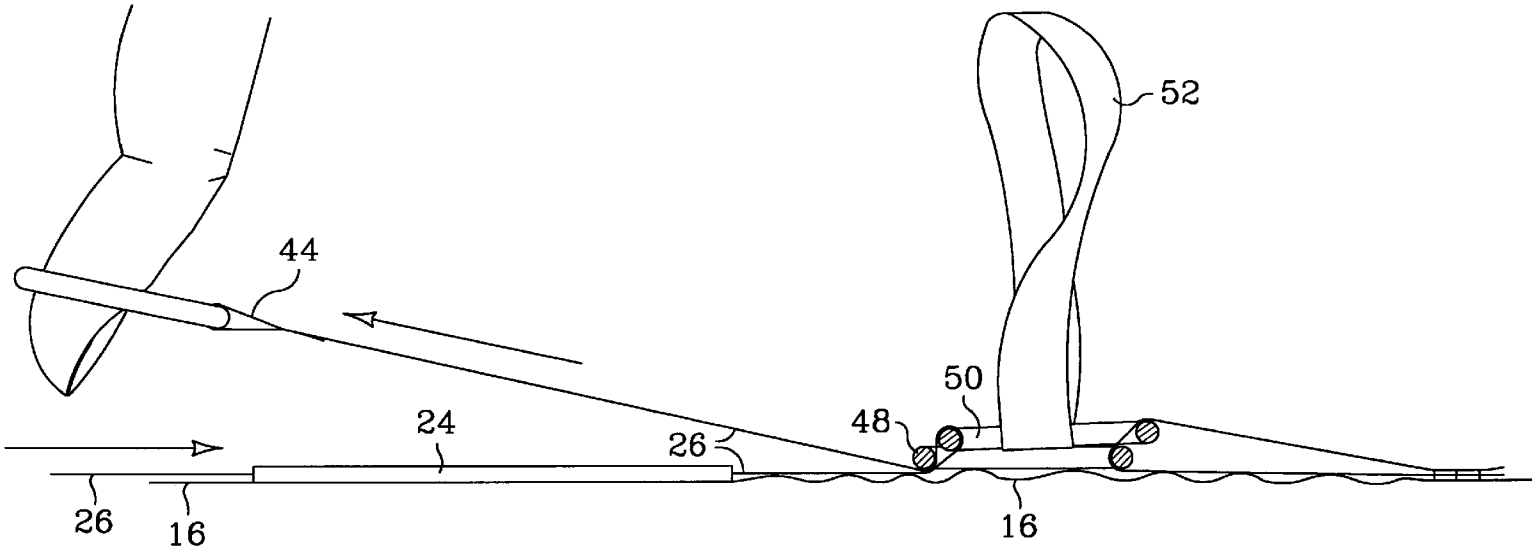
FIG. 4 is a front partial view illustrating how the brassiere of FIG. 2 may be adjusted using the draw straps and buckles.
Figure 5:
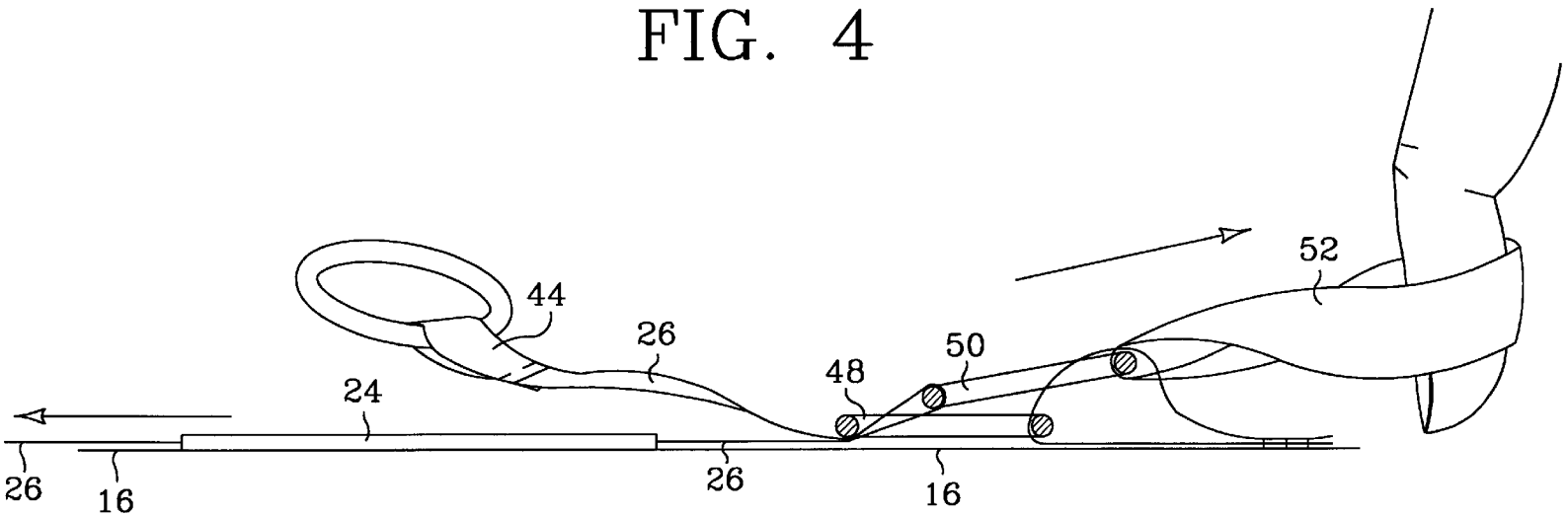
FIG. 5 is a front partial view illustrating how the draw straps in the brassiere of FIG. 2 may be released from the buckles.

In the embodiment illustrated in FIGS. 2, 4 and 5, each buckle 28 will include first and second adjacent rings 48, 50. Free end 44 of each draw strap 26 passes through both rings 48, 50 of one buckle 28, around the second ring 50, and then back through first ring 48. As tension in each draw strap 26 urges strap 26 to retreat within casing 24, rings 48, 50 are forced together securely holding each draw strap 26 in place. Conversely, tension in each draw strap 26 urging strap 26 to extend out of casing 24 forces rings 48, 50 to separate and allows each draw strap 26 to slide through buckle 28. Each buckle 28 also includes a release 52 attached to the buckle's second ring 50. Release 52 when forced away from buckle 28 separates the rings 48, 50 allowing each draw strap 26 to retreat within each casing 24. Alternatively, to secure draw strap 26 to torso encircling band 16, buckles 28 may be formed using hook and loop fasteners or any other suitable mechanism.

Referring now to FIG. 3, to provide lateral breast support, brassiere 22 also includes stays 30 affixed to torso encircling band 16 below arm openings 20. Stays 30 may be formed from flexible sew-through polyester boning or any other suitable semi-rigid material. Affixed to each stay 30 are guides 32 for connecting one draw strap 26 to each stay 30. Each draw strap 26, as it exits a casing's arced portion 34, passes through guides 32 and then through the casing's transfer portion 36 if present. If the arced and transfer portions 34, 36 of each casing 24 form one continuous path, guides 32 may be located within each casing 24 and attached to the stay 30 through the casing's inner wall. As draw straps 26 are pulled through guides 32, draw straps 26 force stays 30 toward the center of the wearer's chest tightening torso encircling band 16. It is envisioned that guides 32 will be plastic rings but may be formed in any other shape and of any other material suitable for attaching to stays 30 while transferring the draw straps 26 between each casing's arced portions 34 and buckles 28

Use

To don brassiere 22 the wearer's arms slip though openings 20 allowing brassiere 22 to slide passed each elbow. The back of brassiere 22 is gathered up and slipped over the wearer's head like a tank top or any other pullover top. With one arm, the wearer can pull brassiere 22 down loosely securing the wearer's breasts in each cup 12. Referring to FIG. 4, to secure brassiere 22 in place and to provide increased breast support, the wearer pulls on the free end 44 of each draw strap 26 securing casings 24 firmly against the wearer's chest and around each breast. As the draw straps 26 slide through guides 32, inward tension is applied to torso encircling band 16 forcing each stay 30 toward the center of the wearer's chest. This force tightens encircling band 16 around the wearer's torso and provides lateral breast support. Buckles 28 hold each draw strap 26 in the extended position.

Figure 6:
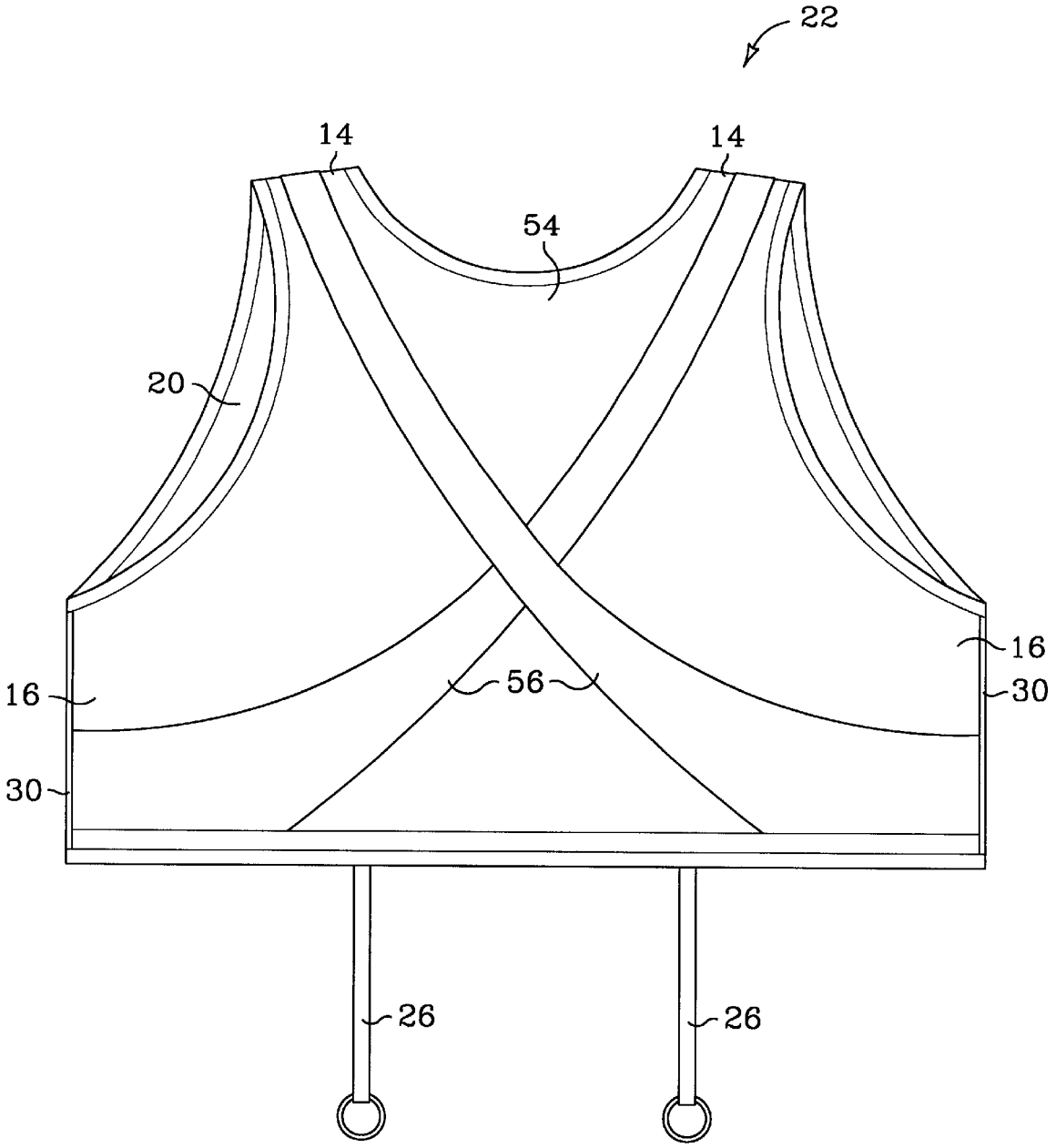
FIG. 6 is rear view of the brassiere of FIG. 2 illustrating the high back and cross bands.

Referring to FIG. 4, to loosen brassiere 22, the wearer pulls on each release 52 allowing draw straps to retreat within casings 24. To allow the wearer to easily slip brassiere 22 over the head, brassiere 22 may incorporate high back 54 connecting shoulder supports 14 to torso encircling belt 16 along the wearer's back as shown in FIG. 6. It is expected that high back 54 will be formed by a solid piece of cloth not unlike the back of a conventional tank top. The wearer can grasp high back 54 in one hand and slide brassiere 22 over the wearer's head. To provide additional back support, it is envisioned that high back 54 will include cross bands 56. Each cross band 56 traverses from one shoulder support 14 across high back 54 to an opposing stay 30. Cross bands 56 may be stitched into the high back 54 or connected directly to the shoulder supports 14 and stays 30, or both. As the wearer pulls on each draw strap 26 forcing each stay 30 toward the center of the wearer's chest, cross bands 56 tighten across the wearer's back. Cross bands 56 may be elastic or constructed of a more firm material.

Although the invention has been shown and described with reference to the foregoing exemplary embodiment, various other embodiments, additions and modifications are possible without departing from the spirit and scope of the invention as defined in the following claims.

What is claimed is:

1. A breast support garment comprising:

a body comprising shoulder supports, a torso encircling band, and at least one breast cup between and connecting the shoulder supports and the torso encircling band;

an arced casing affixed to the body of the garment passing around at least a portion of the breast cup; and a draw strap slideably passing through the arced casing, one end of the draw strap affixed to one shoulder support, the other end remaining free.

2. The garment of claim 1, further comprising a transfer casing affixed to the torso encircling band wherein the draw strap also slideably passes through the transfer casing.

3. The garment of claim 1, further comprising a buckle affixed to the torso encircling band, the buckle configured to secure the draw strap.

4. The garment of claim 3, wherein the buckle comprises a double ring buckle affixed to the torso encircling band, the buckle configured to receive and secure the draw strap.

5. The garment of claim 4, further comprising a release affixed to one ring of each buckle, the release configured to selectively free the draw strap from the buckle.

6. The garment of claim 3, further comprising a stay affixed to the torso encircling band.

7. The garment of claim 6, further comprising a guide for transferring the draw strap from the arced casing to the buckle, the guide affixed to the stay.

8. The garment of claim 6, further comprising a high back connecting the shoulder supports to the torso encircling band along a wearer's back.

9. The garment of claim 8, wherein the high back includes cross supports each traversing the high back and connecting one shoulder support to the stay.

10. A breast support system for a garment having arm and neck openings, the garment formed at least in part by a pair of breast cups each connected between a torso encircling band and one of two shoulder supports, the system comprising:

a pair of arced casings affixed to the body of the garment, each casing passing from one shoulder support over one breast cup, between both breast cups, under the other breast cup and ending near one arm opening;

a pair of transport casings affixed to the torso encircling band each located under one breast cup;

buckles affixed to the torso encircling band between the transfer casings; and draw straps each slideably passing through one arced casing and one transfer casing, one end of each draw strap affixed to one shoulder support and the other end configured to be received by one buckle.

11. The system of claim 10 further comprising a pair of stays located on the torso encircling band, each stay generally located under one arm opening.

12. The system of claim 11 further comprising a high back connecting the shoulder supports to the torso encircling band along a wearer's back.

13. The system of claim 11, wherein the high back includes cross bands each band traversing the high back and connecting one shoulder support to one stay.

14. The system of claim 11, further comprising a guide affixed to each stay, the guides configured to cause torso encircling band to constrict while transferring each draw strap from an arced casing to a buckle.

15. The system of claim 10, wherein the arced casings and the transfer casings form a single pair of continuous casing.

16. The system of claim 10, wherein the buckles each comprise a double ring buckle.

17. The system of claim 16, further comprising a release affixed to one ring of each double ring buckle, the release being configured to free the draw strap from the buckle.

18. A woman's support undergarment having a body with two arm openings, the body being formed, at least in part, by shoulder supports, a torso encircling band, and a pair of breast cups interspaced between and connecting the shoulder supports and the torso encircling band, the undergarment comprising:

a pair of arced casings affixed to the body of the garment, each casing passing from one shoulder support curving over one breast cup, down and across between both breast cups, and continuing across and curving under the other breast cup;

a pair of transfer casings affixed to the torso encircling band each located under one breast cup;

stays affixed to the torso encircling band under each arm opening;

guides affixed to each stay;

buckles affixed to the torso encircling band between the transfer casings; and draw straps each slideably passing through one arced casing, one guide, and one transfer casing, one end of each draw strap affixed to one shoulder support and the other end configured to be received by one buckle.

19. The undergarment of claim 18, further comprising a high back connecting the shoulder supports to the torso encircling band.

20. The undergarment of claim 19, wherein the high back includes a pair of cross bands, each cross band connecting one shoulder support to one stay.

* * * * *